US008675818B2

(12) United States Patent
Wassom

(10) Patent No.: US 8,675,818 B2
(45) Date of Patent: Mar. 18, 2014

(54) CERAMIC METALLIZATION IN AN X-RAY TUBE

(75) Inventor: Jeffrey Steven Wassom, West Jordan, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 352 days.

(21) Appl. No.: 13/084,902

(22) Filed: Apr. 12, 2011

(65) Prior Publication Data

US 2012/0263277 A1 Oct. 18, 2012

(51) Int. Cl.
*H01J 35/02* (2006.01)

(52) U.S. Cl.
USPC ..... 378/121; 378/119

(58) Field of Classification Search
USPC ..... 378/119–144
See application file for complete search history.

(56) References Cited

U.S. PATENT DOCUMENTS

| | | | | |
|---|---|---|---|---|
| 4,705,989 | A * | 11/1987 | Takada et al. | 315/39.51 |
| 6,373,921 | B1 | 4/2002 | Kliman et al. | |
| 2004/0028184 | A1 | 2/2004 | Hansen | |
| 2005/0117704 | A1 | 6/2005 | Tekletsadik et al. | |

OTHER PUBLICATIONS

International Search Report dated Nov. 7, 2012 as received in Application No. PCT/US2012/033113.
Written Opinion of the International Searching Authority dated Nov. 7, 2012 as received in Application No. PCT/U52012/033113.

* cited by examiner

*Primary Examiner* — Hoon Song
(74) *Attorney, Agent, or Firm* — Maschoff Brennan

(57) ABSTRACT

Ceramic metallization in an x-ray tube. In one example embodiment, a metalized ceramic plate for an x-ray tube includes a first side configured to reside inside an evacuated enclosure of an x-ray tube, a second side configured to reside outside the evacuated enclosure, a recess formed in the second side, feedthru openings that extend through the plate between the first side and the recess, and metallization formed around the perimeter of the recess and electrically connected to one of the feedthru openings.

20 Claims, 4 Drawing Sheets

CERAMIC METALLIZATION IN AN X-RAY TUBE

BACKGROUND

X-ray tubes are extremely valuable tools that are used in a wide variety of applications, both industrial and medical. An x-ray tube typically includes a cathode assembly and an anode positioned within an evacuated enclosure. The cathode assembly includes an electron source and the anode includes a target surface that is oriented to receive electrons emitted by the electron source. During operation of the x-ray tube, an electric current is applied to the electron source, which causes electrons to be produced by thermionic emission. The electrons are then accelerated toward the target surface of the anode by applying a high-voltage potential between the cathode assembly and the anode. When the electrons strike the anode target surface, the kinetic energy of the electrons causes the production of x-rays. The x-rays are produced in an omnidirectional fashion where the useful portion ultimately exits the x-ray tube through a window in the x-ray tube, and interacts with a material sample, patient, or other object with the remainder being absorbed by other structures including those whose specific purpose is absorption of x-rays with non-useful trajectories or energies.

During the operation of a typical x-ray tube, the high-voltage power required to power the x-ray tube produces a byproduct of static electric fields. In certain instances these static electric fields can be problematic. For example, when these static electric fields exit the evacuated enclosure of the x-ray and come in contact with air, electrical arcing can occur which can damage the x-ray tube and thereby shorten the operational life of the x-ray tube.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to ceramic metallization in an x-ray tube. Among other things, example embodiments of the ceramic metallization disclosed herein are configured to reduce, if not eliminate, electrical arcing caused by static electric fields in areas outside the evacuated enclosure of the x-ray tube. Reducing electrical arcing, whether internal or external to the evacuated enclosure, reduces damage to the x-ray tube and thereby extends the operational life of the x-ray tube.

In one example embodiment, a metalized ceramic plate for an x-ray tube includes a first side configured to reside inside an evacuated enclosure of an x-ray tube, a second side configured to reside outside the evacuated enclosure, a recess formed in the second side, feedthru openings that extend through the plate between the first side and the recess, and metallization formed around the perimeter of the recess and electrically connected to one of the feedthru openings.

In another example embodiment, an x-ray tube includes an anode, a cathode assembly including electrical conductors, and an evacuated enclosure within which the anode and the cathode assembly are at least partially positioned. The evacuated enclosure is at least partially defined by a metalized ceramic plate. The ceramic plate includes a first side residing inside the evacuated enclosure, a second side residing outside the evacuated enclosure, a recess formed in the second side, feedthru openings that extend through the plate between the first side and the recess, and metallization formed around the perimeter of the recess and electrically connected to one of the electrical conductors. The electrical conductors extend through the feedthru openings and are brazed within the feedthru openings to hermetically seal the feedthru openings.

In yet another example embodiment, an x-ray tube includes a rotatable anode, a cathode assembly including electrical conductors, an evacuated enclosure within which the rotatable anode and the cathode assembly are at least partially positioned and at least partially defined by a metalized ceramic plate, a high-voltage connector removably coupled to the evacuated enclosure, and a high-voltage gasket sealing the high-voltage connector to the plate. The plate includes a first side residing inside the evacuated enclosure, a second side residing outside the evacuated enclosure, a recess formed in the second side, feedthru openings that extend through the plate between the first side and the recess, and metallization formed around the perimeter of the recess and electrically connected to one of the electrical conductors. The electrical conductors extend through the feedthru openings and are brazed within the feedthru openings to hermetically seal the feedthru openings. The high-voltage connector is configured to electrically couple a high-voltage electrical cable to the cathode assembly. The high-voltage connector includes a potting material configured to insulate electrical conductors that are coupled to the cathode assembly and that run through the high-voltage connector. The high-voltage gasket seals the high-voltage connector to the plate. The high-voltage gasket also surrounds the electrical conductors that run through the high-voltage connector.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to ceramic metallization in an x-ray tube. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. Example X-Ray Tube

Figure 1A:
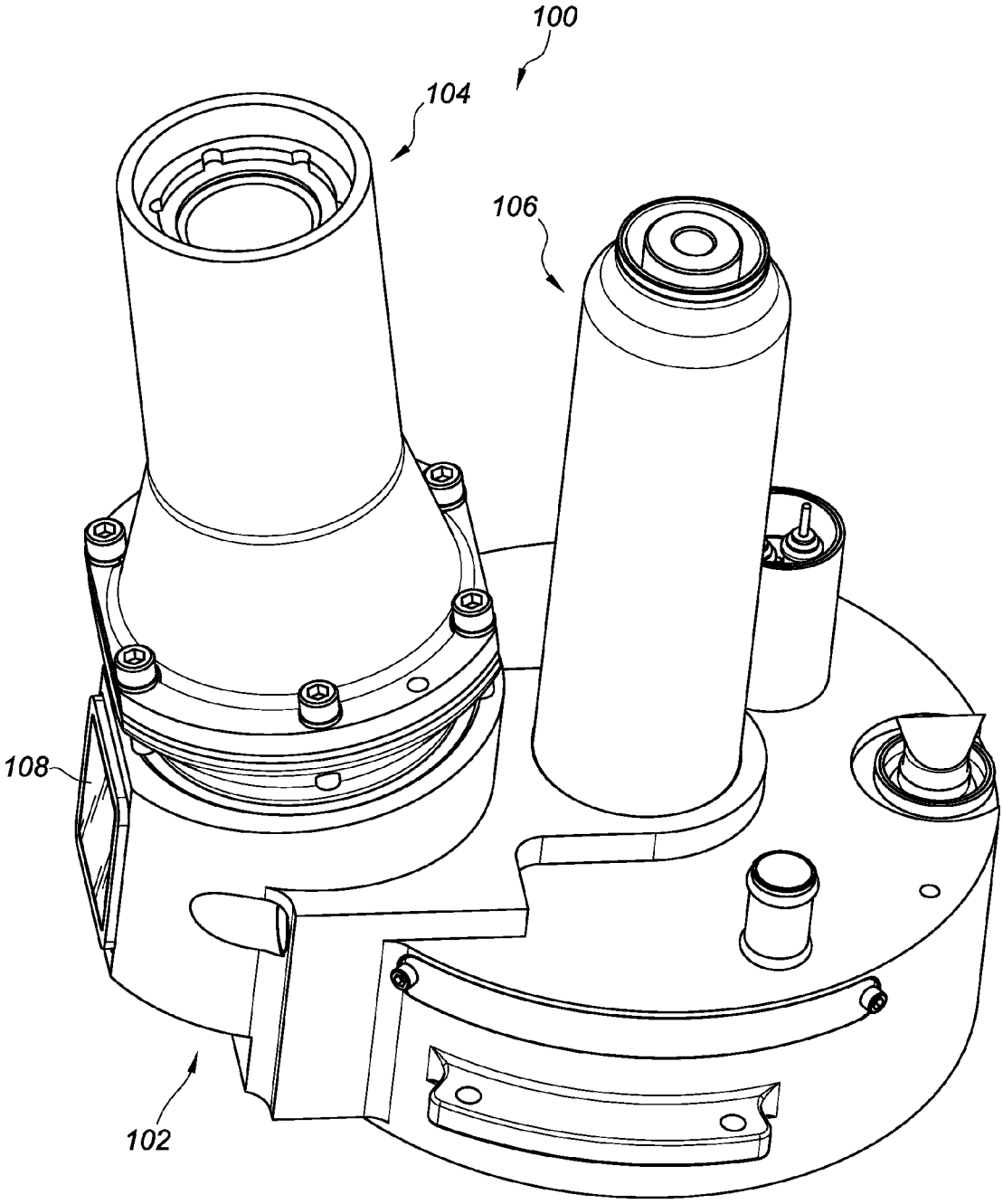
FIG. 1A is a perspective view of an example x-ray tube.
Figure 1B:
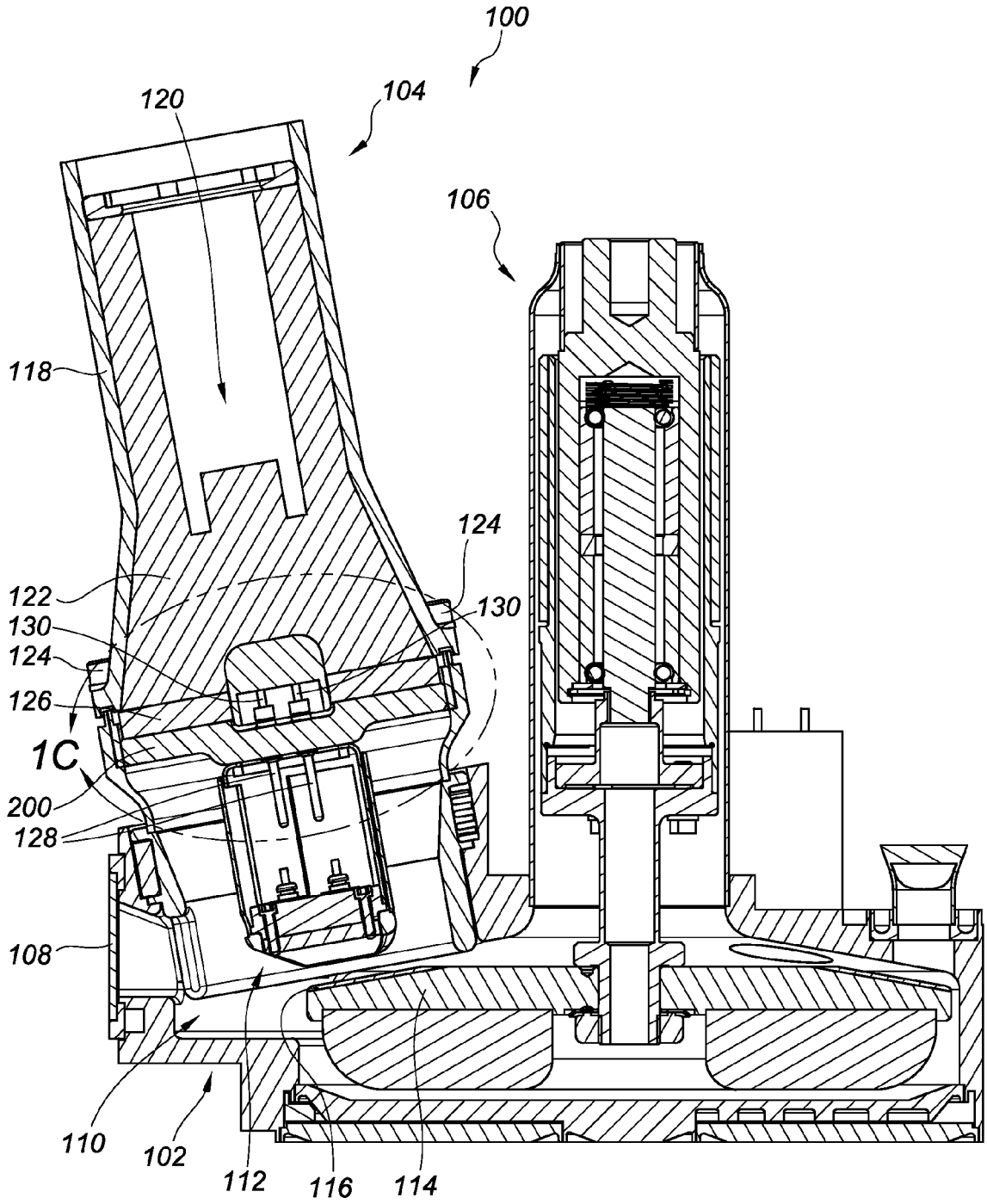
FIG. 1B is a cross-sectional side view of the example x-ray tube of FIG. 1A.
Figure 1C:
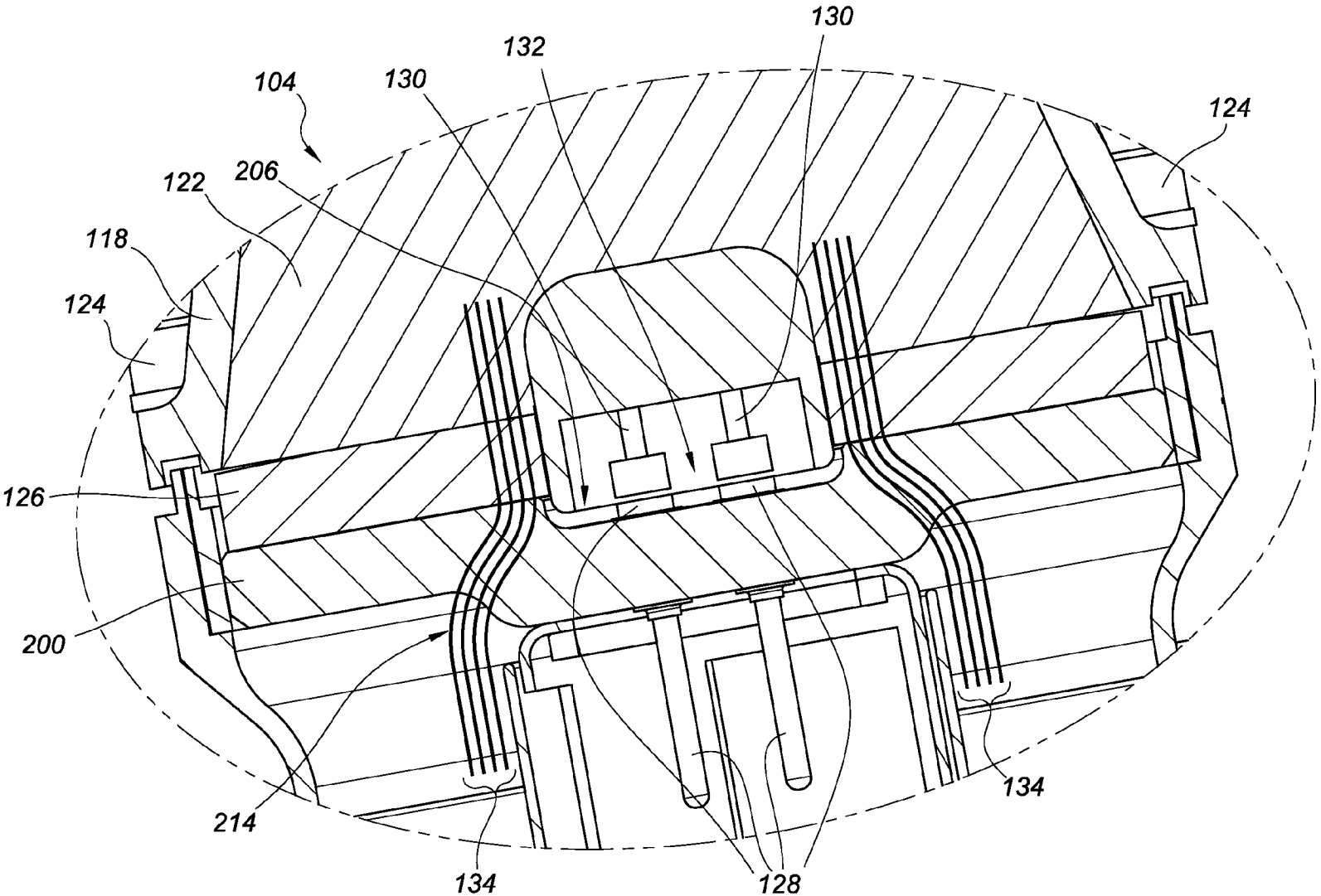
FIG. 1C is an enlarged cross-sectional side view of a portion of the example x-ray tube of FIG. 1B.

With reference first to FIGS. 1A-1C, an example x-ray tube 100 is disclosed. The example x-ray tube 100 is configured for use in mammography applications, but it is understood that the metalized ceramic devices disclosed herein can be employed in x-ray tubes configured for use in other applications including, but not limited to, computed tomography (CT), diagnostic, or industrial.

As disclosed in FIG. 1A, the example x-ray tube 100 generally includes a can 102, a high-voltage connector 104 removably attached to the can 102, a stator 106 attached to the can 102, and an x-ray tube window 108 attached to the can 102. The x-ray tube window 108 is comprised of an x-ray transmissive material, such as beryllium or other suitable material(s). The can 102 may be formed from stainless steel, such as 304 stainless steel.

As disclosed in FIG. 1B, the x-ray tube window 108, the can 102, and an example metalized ceramic plate 200 at least partially define an evacuated enclosure 110 within which a cathode assembly 112 and a rotatable anode 114 are positioned. More particularly, the cathode assembly 112 extends from the metalized ceramic plate 200 into the can 102 and the anode 114 is also positioned within the can 102. The anode 114 is spaced apart from and oppositely disposed to the cathode assembly 112, and may be at least partially composed of a thermally conductive material such as tungsten or a molybdenum alloy for example. The anode 114 and cathode assembly 112 are connected in an electrical circuit that allows for the application of a high voltage potential between the anode 114 and the cathode assembly 112. The cathode assembly 112 includes emitters (not shown) that are connected to an appropriate power source (not shown). The anode 114 is rotated by the stator 106.

With continued reference to FIG. 1B, prior to operation of the example x-ray tube 100, the evacuated enclosure 110 is evacuated to create a vacuum. Then, during operation of the example x-ray tube 100, an electrical current is passed through the emitters (not shown) of the cathode assembly 112 to cause electrons to be emitted from the cathode assembly 112 by thermionic emission. The application of a high voltage differential between the anode 114 and the cathode assembly 112 then causes the electrons to accelerate from the cathode assembly 112 and toward a rotating focal track 116 that is positioned on the rotating anode 114. The focal track 116 may be composed for example of tungsten or other material(s) having a high atomic ("high Z") number. As the electrons accelerate, they gain a substantial amount of kinetic energy, and upon striking the target material on the rotating focal track 116, some of this kinetic energy is converted into x-rays.

The focal track 116 is oriented so that many of the emitted x-rays are directed toward the x-ray tube window 108. As the x-ray tube window 108 is comprised of an x-ray transmissive material, the x-rays emitted from the focal track 116 pass through the x-ray tube window 108 in order to strike an intended target (not shown) to produce an x-ray image (not shown). The window 108 therefore hermetically seals the vacuum of the evacuated enclosure of the x-ray tube 100 from the atmospheric air pressure outside the x-ray tube 100 and yet enables the x-rays generated by the rotating anode 114 to exit the x-ray tube 100. The example metalized ceramic plate 200 is brazed to surrounding structures of the can 102 and also hermetically seals the vacuum of the evacuated enclosure of the x-ray tube 100 from the atmospheric air pressure outside the x-ray tube 100.

Although the example x-ray tube 100 is depicted as a rotatable anode x-ray tube, example embodiments disclosed herein may be employed in other types of x-ray tubes. Thus, the example ceramic metallization disclosed herein may alternatively be employed, for example, in a stationary anode x-ray tube.

2. Example Metalized Ceramic Plate

With reference now to FIGS. 1B, 1C, 2A, and 2B, additional aspects of the example metalized ceramic plate 200, high voltage connector 104, and cathode assembly 112 are disclosed. As disclosed in FIGS. 1B and 1C, the example high-voltage connector 104 includes a shell 118, a receptacle 120 defined in the shell 118, and a potting material 122 positioned within the shell 118. The receptacle 120 is configured to receive a high-voltage electrical cable (not shown) in order to receive high-voltage electrical power into the high-voltage connector 104. The shell 118 is removably coupled to the evacuated enclosure 110 of the x-ray tube 100 using the fasteners 124 in order to enable electrical coupling of the high-voltage electrical cable (not shown) to the emitters (not shown) of the cathode assembly 112. The removability of the high-voltage connector 104 enables the high-voltage connector 104 and/or a high-voltage gasket 126 to be removed and/or replaced during servicing of the x-ray tube 100. The potting material 122 insulates the electrical conductors 130 running through the high-voltage connector 104.

As disclosed in FIGS. 1B and 1C, the high-voltage gasket 126 seals the high-voltage connector 104 to the example metalized ceramic plate 200. As disclosed in FIGS. 1B and 1C, the cathode assembly 112 includes electrical conductors 128 that extend through the example metalized ceramic plate 200 and electrically couple to a high-voltage electrical cable (not shown) that is received in the receptacle 120 of the high-voltage connector 104. The high-voltage gasket 126 is configured to withstand and insulate the high-voltage electrical power communicated through the high-voltage connector 104. The high-voltage gasket 126 also functions to continue the dielectric path between the high-voltage potentials of the electrical conductors 130 and the grounded potential shell 118.

As disclosed in FIGS. 1B and 1C, and as noted above, the example metalized ceramic plate 200 partially defines the evacuated enclosure 110 and is configured to hermetically seal the evacuated interior of the evacuated enclosure 110 from the atmospheric air pressure outside the x-ray tube 100. The example metalized ceramic plate 200 also provides structural support to surrounding structures of the evacuated enclosure 110.

Figure 2A:
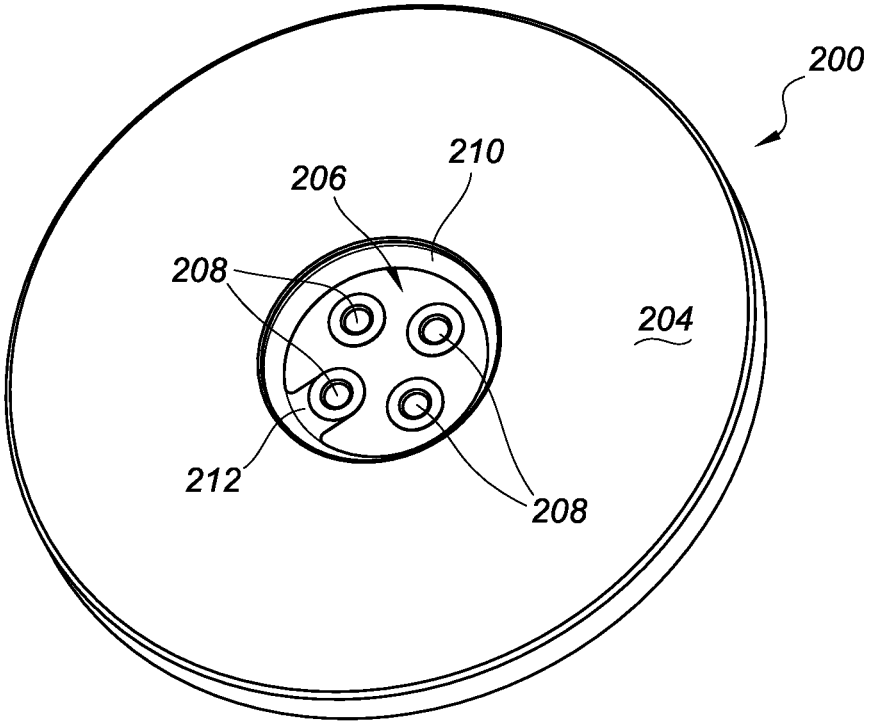
FIG. 2A is a rear view of an example metalized ceramic plate of the example x-ray tube of FIGS. 1A-1C.
Figure 2B:
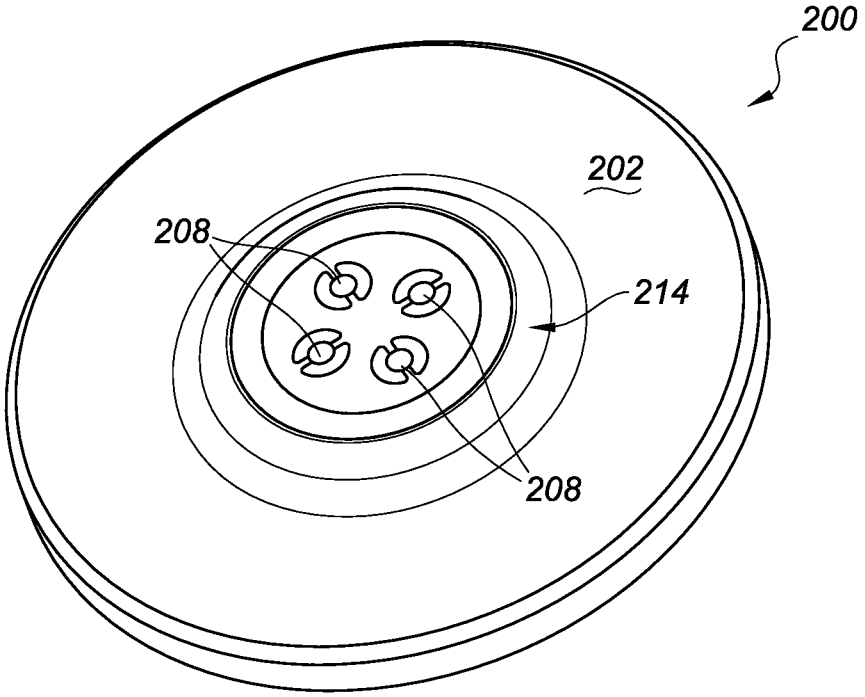
FIG. 2B is a front view of the example metalized ceramic plate of FIG. 2A.

As disclosed in FIGS. 2A and 2B, the example metalized ceramic plate 200 includes a first side 202 configured to reside inside the evacuated enclosure 110 of the x-ray tube 100 and a second side 204 configured to reside outside the evacuated enclosure 110. The example metalized ceramic plate 200 also includes a recess 206 formed in the second side 204 and feedthru openings 208 that extend through the plate 200 between the first side 202 and the recess 206. Although four feedthru openings 208 are disclosed in FIGS. 2A and 2B, it is understood that the example metalized ceramic plate 200 may instead include two or three feedthru openings 208, or five or more feedthru openings 208. The feedthru openings 208 may also be metalized so that during the manufacture of the x-ray tube 100, the electrical conductors 128 (see FIG. 1A) extending through the feedthru openings 208 can be brazed within the feedthru openings 208. Brazing the electrical conductors 128 (see FIG. 1A) within the feedthru openings 208 hermetically seals the feedthru openings 208 and thereby enables the evacuation of air from the evacuated enclosure 110.

The example metalized ceramic plate 200 further includes metallization 210 formed around the perimeter of the recess 206. The metallization 210 may be formed from various conductive materials such as, but not limited to, molybdenum manganese (MoMn), for example. As disclosed in FIG. 2A, the perimeters of the plate 200 and the recess 206 are both substantially circular, but it is understood that one or both of these perimeters could instead have another shape such as an oval, rectangular, square, or triangular shape. The metallization 210 is electrically connected via metallization 212 to one of the feedthru openings 208. The metallization 212 that is positioned between the metallization 210 and the feedthru opening 208 is but one method of electrically connecting the metallization 210 to the metallization of the feedthru opening 208, and other methods of electrical connection are possible and contemplated. This electrical connection at 212 enables the metallization 210 to be kept at the same electrical potential as the electrical conductor 128 (see FIG. 1C) extending through the connected feedthru opening 208. It is understood that the metallization 210 may instead be electrically connected to two or more of the feedthru openings 208.

The metallization 210 functions to shape static electric fields 134 that flow through the plate 200 and the high-voltage gasket 126 to avoid any air that is present in the cavity 132 (see FIG. 1C). In the absence of the metallization 210, static electric fields would tend to flow closer to the electrical conductors 128 and 130, which can cause problems with electrical arcing in the cavity 132. The employment of the metallization 210, however, causes the static electric fields 134 to flow further from the electrical conductors 130, thereby avoiding the cavity 132 and the electrical conductors 128 and 130 running through the cavity 132. The metallization 210 thus functions similarly to a Faraday shield in directing the static electric fields 134 away from any air that is present in the cavity 132, thus reducing or eliminating electrical arcing in the cavity 132. Reducing electrical arcing in the x-ray tube 100, whether internal or external to the evacuated enclosure 110, reduces damage to the x-ray tube and thereby extends the operation life of the x-ray tube 100. As electrical arcing can in some instances cause instant catastrophic failure in an x-ray tube, reducing electrical arcing in the x-ray tube 100 can also enable the x-ray tube 100 avoid instant catastrophic failure. This extension of the operation life of the x-ray tube 100 is accomplished using a relatively simple one-piece metalized design which is less complicated and less costly than a multi-piece ceramic design that includes a cylindrical metal Faraday shield interposed between the multiple ceramic pieces.

The example metalized ceramic plate 200 may also include a mound 214 formed on the first side 202 opposite the recess 206. As disclosed in FIG. 1C, the diameter of the mound 214 may be greater than a diameter of the recess 206. The mound 214 may function to further shape the static electric fields 134 that flow through the plate 200. The example metalized ceramic plate 200 may also include a metallization formed on the first side 202 opposite the recess 206. The metallization formed on the first side 202 of the plate 200 may be used as a mechanical braze surface.

Further, while the example ceramic metallization 210 disclosed in connection with FIG. 2A generally serves to shape static electric fields 134 that flow through the plate 200 at the cathode end of an x-ray tube 100, it is understood that ceramic metallization can similarly be employed to shape static electric fields at the anode end of an x-ray tube 100. The example ceramic metallization 210 disclosed herein can thus be employed in various regions of an x-ray tube.

The example embodiments disclosed herein may be embodied in other specific forms. The example embodiments disclosed herein are therefore to be considered in all respects only as illustrative and not restrictive.

What is claimed is:

1. A metalized ceramic plate for an x-ray tube, the plate comprising:
- a first side configured to reside inside an evacuated enclosure of an x-ray tube;
- a second side configured to reside outside the evacuated enclosure;
- a recess formed in the second side;
- feedthru openings that extend through the plate between the first side and the recess; and
- metallization formed around the perimeter of the recess and electrically connected to one of the feedthru openings.

2. The metalized ceramic plate as recited in claim 1, further comprising a mound formed on the first side opposite the recess.

3. The metalized ceramic plate as recited in claim 2, further comprising metallization formed on the first side.

4. The metalized ceramic plate as recited in claim 1, where the feedthru openings comprise four feedthru openings.

5. The metalized ceramic plate as recited in claim 1, wherein the perimeter of the plate is substantially circular.

6. The metalized ceramic plate as recited in claim 1, wherein the metallization comprises molybdenum manganese (MoMn).

7. An x-ray tube comprising:
- an anode;
- a cathode assembly including electrical conductors; and
- an evacuated enclosure within which the anode and the cathode assembly are at least partially positioned, the evacuated enclosure is at least partially defined by a metalized ceramic plate, the plate comprising:
  - a first side residing inside the evacuated enclosure;
  - a second side residing outside the evacuated enclosure;
  - a recess formed in the second side;
  - feedthru openings that extend through the plate between the first side and the recess, the electrical conductors extending through the feedthru openings and brazed within the feedthru openings to hermetically seal the feedthru openings; and
  - metallization formed around the perimeter of the recess and electrically connected to one of the electrical conductors.

8. The x-ray tube as recited in claim 7, wherein the plate further comprises a mound formed on the first side opposite the recess.

9. The x-ray tube as recited in claim 8, wherein the plate further comprises metallization formed on the first side.

10. The x-ray tube as recited in claim 7, wherein:
- the electrical conductors comprise four electrical conductors; and
- the feedthru openings comprise four feedthru openings.

11. The x-ray tube as recited in claim 7, wherein the perimeter of the recess is substantially circular.

12. The x-ray tube as recited in claim 7, wherein the metallization comprises molybdenum manganese (MoMn).

13. An x-ray tube comprising:
- a rotatable anode;
- a cathode assembly including electrical conductors;
- an evacuated enclosure within which the rotatable anode and the cathode assembly are at least partially positioned, the evacuated enclosure at least partially defined by a metalized ceramic plate, the plate comprising:
  - a first side residing inside the evacuated enclosure;
  - a second side residing outside the evacuated enclosure;
  - a recess formed in the second side;

feedthru openings that extend through the plate between the first side and the recess, the electrical conductors extending through the feedthru openings and brazed within the feedthru openings to hermetically seal the feedthru openings; and metallization formed around the perimeter of the recess and electrically connected to one of the electrical conductors;

a high-voltage connector removably coupled to the evacuated enclosure, the high-voltage connector configured to electrically couple a high-voltage electrical cable to the cathode assembly, the high-voltage connector including a potting material configured to insulate electrical conductors that are coupled to the cathode assembly and that run through the high-voltage connector; and a high-voltage gasket sealing the high-voltage connector to the plate, the high-voltage gasket also surrounding the electrical conductors that run through the high-voltage connector.

14. The x-ray tube as recited in claim 13, wherein the plate further comprises a mound formed on the first side opposite the recess, a diameter of the mound being greater than a diameter of the recess.

15. The x-ray tube as recited in claim 14, wherein the perimeter of the recess of the plate is substantially circular.

16. The x-ray tube as recited in claim 14, wherein the plate further comprises metallization formed on the first side.

17. The x-ray tube as recited in claim 13, wherein:

the electrical conductors comprises four electrical conductors; and the feedthru openings comprises four feedthru openings.

18. The x-ray tube as recited in claim 13, wherein:

the perimeter of the recess is substantially circular; and the perimeter of the plate is substantially circular.

19. The x-ray tube as recited in claim 13, wherein the metallization comprises molybdenum manganese (MoMn).

20. The x-ray tube as recited in claim 13, wherein the metallization formed around the perimeter of the recess is configured to shape static electric fields flowing through the metalized ceramic plate in order to reduce electrical arcing in the recess.

* * * * *